US009380677B2

(12) United States Patent
Van Endert et al.

(10) Patent No.: US 9,380,677 B2
(45) Date of Patent: Jun. 28, 2016

(54) ADDRESS INITIALIZATION OF LIGHTING DEVICE UNITS

(75) Inventors: Tony Petrus Van Endert, Eindhoven (BE); Markus Wilhelmus Maria Coopmans, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 164 days.

(21) Appl. No.: 13/996,635

(22) PCT Filed: Dec. 19, 2011

(86) PCT No.: PCT/IB2011/055776

§ 371 (c)(1),
(2), (4) Date: Jun. 21, 2013

(87) PCT Pub. No.: WO2012/085816

PCT Pub. Date: Jun. 28, 2012

(65) Prior Publication Data

US 2013/0293153 A1 Nov. 7, 2013

(30) Foreign Application Priority Data

Dec. 22, 2010 (EP) ..... 10196378

(51) Int. Cl.
*H05B 37/02* (2006.01)
*G05F 1/00* (2006.01)
*H05B 33/08* (2006.01)

(52) U.S. Cl.
CPC ..... *H05B 37/02* (2013.01); *H05B 33/083* (2013.01); *H05B 37/0254* (2013.01)

(58) Field of Classification Search
CPC ..... H05B 37/02; H05B 37/0272
USPC ..... 315/297, 320, 312; 710/9, 107; 700/20, 700/11, 275
See application file for complete search history.

(56) References Cited

U.S. PATENT DOCUMENTS 7,139,839 B2 * 11/2006 White ..... H04L 12/403 370/254
2002/0188781 A1 * 12/2002 Schoch ..... G06F 13/37 710/107
2007/0260764 A1 11/2007 Summers et al.
2008/0155219 A1 * 6/2008 Pyeon ..... G06F 13/4291 711/170

(Continued)

FOREIGN PATENT DOCUMENTS

DE 102004043197 A1 3/2006
DE 10201000256 A1 9/2011
EP 0898442 A1 2/1999
GB 2467196 A 7/2010
JP 2004063216 A 2/2004
JP 2009503778 A 1/2009

(Continued)

*Primary Examiner* — Lincoln Donovan
*Assistant Examiner* — Thomas Skibinski
(74) *Attorney, Agent, or Firm* — Meenakshy Chakravorty

(57) ABSTRACT

In a lighting device, a primary control unit (103) and a group of light units (107) are arranged in a power supply chain, each light unit (107) of said group being arranged for receiving commands from the primary control unit (103) via a light unit interface (117) of the light unit (107), wherein each succeeding unit (103; 107) of the chain has a power input (145) which is connected to a switchable power output (147) of a respective preceding unit (103; 107), each preceding unit (103; 107) being arranged to supply power at the power output (147) only after initializing an address identification of the unit, and each succeeding unit (103; 107) being arranged to initialize an address identification of the unit upon being supplied with power at the power input (145).

15 Claims, 3 Drawing Sheets

(56) References Cited

U.S. PATENT DOCUMENTS

| | | | | |
|---|---|---|---|---|
| 2009/0021955 | A1* | 1/2009 | Kuang | B60Q 3/0259 362/479 |
| 2010/0079091 | A1* | 4/2010 | Deixler | H05B 7/0254 315/320 |

FOREIGN PATENT DOCUMENTS

| | | | |
|---|---|---|---|
| WO | 2008068728 | A1 | 6/2008 |
| WO | 2009090601 | A1 | 7/2009 |
| WO | 2010057241 | A1 | 5/2010 |
| WO | 2010066678 | A1 | 6/2010 |

* cited by examiner

ADDRESS INITIALIZATION OF LIGHTING DEVICE UNITS

FIELD OF THE INVENTION

The invention relates to the field of lighting devices and initializing addresses of lighting device units of a lighting device. More specifically, the invention relates to a lighting device comprising a group of light units, and to a method of initializing addresses of lighting device units of a lighting device.

BACKGROUND OF THE INVENTION

US 2004/0232856 A1 describes a lighting system having ballasts which are connected to lamps and at least one controller for controlling the ballasts and thus the operation of the lamps. Before installation in the lighting system, the ballasts are provided with codes which are individual for each of the ballasts and can be addressed externally by signaling. These codes are read during the installation of the lighting system and are entered in a controller. The controller assigns drive addresses for drive purposes to each of the ballasts, and the controller uses the drive addresses to control the ballasts. Controllers are connected by means of control signal outputs to a control signal line or bus line, to which the electronic ballasts are connected.

SUMMARY OF THE INVENTION

It is an object of the invention to provide a lighting device wherein address initialization of units of the lighting device within the lighting device is simplified.

This object is achieved by a lighting device, comprising:

- a primary control unit comprising a control unit interface; and
- a group of light units, each light unit of said group being arranged for receiving commands from the primary control unit via a light unit interface of the light unit,
- wherein said group of light units and said primary control unit are arranged in a power supply chain, wherein each succeeding unit comprises a power input which is connected to a switchable power output of a respective preceding unit, and
- wherein each preceding unit is arranged to supply power at the power output only after initializing an address identification of the unit, and
- wherein each succeeding unit is arranged to initialize an address identification of the unit upon being supplied with power at the power input.

In the following, the power supply chain will also be termed as a chain of units. For example, said chain is a linear chain, as opposed to a closed loop chain.

Preferably, said lighting device is a luminaire, a light source, or a fixture.

For example, said lighting device may be an arrangement of lighting device units, such as a primary control unit and at least one light unit, said arrangement having a common power supply. For example, said common power supply is a power supply for all units of the lighting device. For example, the lighting device may comprise said common power supply.

In the following, the term lighting device unit is used to include a light unit as well as said primary control unit and an optional secondary control unit.

Preferably, said address identification may be an interface address of the light unit. Said address identification of a unit is used e.g. when communicating a light generation control command to a respective light unit in an addressing communication mode, after the address initialization stage. For example, said address identifications are internal to the lighting device. Thus, they may not be visible outside the lighting device.

Since each succeeding unit is powered only after an address of the preceding unit has been initialized, address initialization is simplified. For example, address initialization of a preceding unit may take place without interference from address initialization operations of a succeeding unit. In particular, the units may be initialized one after the other. Moreover, when only one unit is switched on at a time, a power consumption peak may be reduced compared to switching on all units simultaneously. Furthermore, the structure of the lighting device units may be simplified, because initialization of each unit may start at power-up of the respective unit.

Thus, in particular, the structure of the light units may be simplified, because the chain structure insures that only one light unit is initialized at a time. Thus, address identifications that are unique within the lighting device may be assigned to the units in a simple manner, e.g. based on address initialization procedures known as such in the art.

For example, said units of the chain of units each comprise an address initializer for initializing an address identification of the unit, which initializer is connected to said interface of the respective unit and arranged to obtain an address identification of the unit. Thus, the address initializer is arranged to perform said initializing an address identification of the unit.

Preferably, each unit of the chain of units is arranged to supply power at the power output only after initializing an address identification of the unit. For example, each unit of the chain of units is arranged to initialize an address identification of the unit upon being supplied with power at the power input.

For example, said initializing an address identification of the unit may comprise setting an address of the unit.

Preferably, a first unit in the chain of units is arranged to assign different address identifications to succeeding units and communicate said address identifications to the respective succeeding units, and each succeeding unit of the chain of units is arranged to receive an address identification from the first unit in the chain of units. For example, the succeeding unit sets its address identification to the received address interface identification. Thus, the first unit manages the address assignment for itself and the succeeding units. For example, any succeeding unit may communicate only with the first unit during address initialization. Thus, initialization is simplified. For example, any communication between units during the address initialization phase is only initiated by the first unit, and there is only communication between the first unit and each other unit.

For example, each unit of the chain is arranged to assign, in case said unit is the first unit in the chain, different address identifications to succeeding units and communicate said address identifications to the respective succeeding units, and each unit of the chain of units is arranged to receive, in case said unit is a succeeding unit in the chain of units, an address identification from the first unit in the chain of units. Thus, each of the units of the chain of units may be adapted to fulfill the role of the first unit and the role of a succeeding unit with regard to the address initialization behavior at power-up. Thus, the units may be arranged in any order in the power supply chain. Preferably, a new address identification is communicated to a succeeding unit using a default address for addressing the unit.

For example, said initializing an address identification of a unit comprises:

assigning, in case the unit is the first unit in the chain of units, an address identification; and receiving, in case the unit is a succeeding unit in the chain of units, an address identification from the first unit in the chain of units. For example, the address identification is received via the interface of the respective unit and via the interface of the first unit.

For example, said initializing an address identification of a unit comprises:

assigning, in case the unit is the primary control unit, a predetermined primary control unit address identification. For example, the primary control unit may always set its address to the predetermined primary control unit address identification, thereby overruling any assigned address in case the primary control unit is not the first unit in the chain of units.

For example, each light unit of said group of light units is arranged to notify, in case said light unit is the first unit in the chain of units, the primary control unit of completion of the address initialization of all succeeding units of the chain of units. Thus, said unit is arranged to report to the primary control unit that the address initialization stage is completed.

For example, a predetermined primary control unit address is used for said notifying.

For example, each unit of said chain of units other than the primary control unit (i.e. each light unit and, if applicable, each secondary control unit) is arranged to notify, in case said unit is the first unit in the chain of units, the primary control unit of completion of the address initialization of all succeeding units of the chain of units.

For example, the control unit interface is a bus interface, and the light unit interfaces are bus interfaces. For example, the bus interfaces are serial bus interfaces. For example, the light unit interfaces are connected to the control unit interface. For example, the light unit interfaces are connected to the control unit interface via a lighting device bus. For example, said lighting device bus may be a serial bus. When each succeeding unit is powered only after an address of the preceding unit has been initialized, address initialization of units connected to a bus is simplified. In particular, for example, units having the same default address may be connected to the bus. In the address initialization stage, each unit of the chain of units may obtain an individual address. Thus, afterwards, the units may be addressed on an individual basis. During the initialization stage, for example, only one unit at a time is operated with the default address. For example, each other unit is only powered after the default address of a preceding unit has been changed to an individual address. Said individual address may be an address identification received from the first unit, or, in case of the first unit or the primary control unit, an address assigned by the unit to itself. Thus, for example, there is no need for a manual configuration step, neither during manufacture of a unit or lighting device nor during installation, to assign an address to an individual unit.

For example, each unit of the chain of units is arranged to operate, in case said unit is a succeeding unit in the chain of units, its respective control unit interface or light unit interface in a slave communication mode only, at least until completion of said initializing an address identification of the unit. In a slave communication mode, an interface does not initiate communication, but only receives and/or responds to communication requests or communicated commands. For example, only the first unit operates its respective control unit interface or light unit interface in a master communication mode, at least until completion of said initializing an address identification of the unit. Thus, communication during address initialization is simplified. For example, address initialization of a unit may take place without interference from bus operations of another unit. Thus, in case the first unit is a light unit, the light unit may communicate an address identification to a succeeding unit, wherein the light unit interface of the first unit is operated in a master communication mode during the address initialization stage of the light device.

For example, said initializing an address identification of the unit comprises changing a default address identification to an individual address identification. For example, each unit of the chain of units may obtain an individual address. For example, said individual address may be unique within the lighting device. For example, said default address identification is common to said units of the chain of units. That is, all units may have the same default address at power-up. Thus, configuration of the units is simplified. For example, manufacture and installation of the units is simplified. For example, said assigning an address identification may comprise changing a default address identification to an individual address identification.

In an alternative example, the primary control unit is the first unit of the chain of units and is the only unit of the chain of units which is arranged to assign different address identifications to succeeding units. Therefore, each light unit of the chain of units is a succeeding unit and is arranged to receive an address identification from the primary control unit. In this alternative example, the light unit may be operated in a slave communication mode only.

In one embodiment, the primary control unit is arranged to obtain a lighting device control command; and each light unit of said group of light units is arranged for receiving light generation control commands via the light unit interface of the light unit, wherein the primary control unit is arranged to select, on the basis of an obtained lighting device control command, a broadcast communication mode or an addressing communication mode of the control unit interface, and to communicate at least one light generation control command to at least one of said light unit interfaces of at least one respective light unit of said group of light units via the control unit interface using the selected communication mode.

Thus, after the address initialization stage, the light units may be addressed using individual addresses. By selecting, on the basis of the obtained lighting device control command, a broadcast communication mode or an addressing communication mode, the efficiency of communication within the lighting device (intra lighting device communication) is higher than in a configuration, in which only a broadcasting mode is used, as well as in a configuration, in which only an addressing mode is used. A broadcasting mode is more efficient in most cases compared with an addressing mode, but, depending on the functions provided by the lighting device, there may be situations in which the addressing mode is more efficient.

For example, the primary control unit may comprise a lighting device interface arranged for receiving said lighting device control command. Thus, for example, the primary control unit may comprise a lighting device interface as well as said control unit interface.

In an addressing communication mode, also termed an addressing mode or an individually addressing communication mode, a communication message provided by the primary control unit may comprise the address identification specific to a respective one of the light units. For example, the address identifications may be unique within an individual lighting device, i.e. amongst the light units, the primary control unit and, optionally, further control units of the lighting device. For example, address identifications may be used in an addressing mode only, but not in a broadcast mode.

A light generation control command specifies an action to be taken by the light unit(s) to which the command is directed, which action is related to an attribute of light generation, such as light on/off, light intensity, hue, etc.

For example, each light unit of said group of light units may comprise at least one light element and at least one light element controller connected to the at least one light element and arranged to generate light element drive signals on the basis of a light generation control command received via the light unit interface of the light unit. It should be noted that the term "light element" is understood to include a single light emitter, which is the typical situation, as well as a group of light emitters, which are driven simultaneously, i.e. by the same drive signal. For example, the light element controller is arranged to calculate a drive signal for the at least one light element and to feed the drive signal to the at least one light element, and more particularly to at least one light element driver thereof.

For example, the primary control unit is arranged to output, in case the selected communication mode is a broadcast communication mode, said at least one light generation control command at the control unit interface, and to output, in case the selected communication mode is an addressing communication mode, at least one address identification specific to one of the light units and said at least one light generation control command at the control unit interface. Thus, a specific address identification in only output in an addressing communication mode, but not in a broadcast communication mode. For example, in a broadcast communication mode, a broadcast identifier, e.g. in the form specifying an address "0", may be output instead of a specific address identification. For example, the control unit interface and the light unit interfaces are bit serial interfaces.

For example, the primary control unit is arranged to selectively communicate, in case the selected communication mode is an addressing communication mode, at least one light generation control command to at least one of said light unit interfaces of at least one respective light unit of said group of light units via the control unit interface using the selected communication mode and using at least one light unit address identification.

For example, said light unit interfaces are arranged to receive light generation control commands in a broadcast communication mode and in an addressing communication mode.

For example, the primary control unit may comprise a translator for receiving a lighting device control command requiring light generation control of at least two light units of the lighting device, i.e. requiring control of light generation of said at least two light units of the lighting device, and for translating the lighting device control command into light generation control commands for each of said at least two light units, wherein the primary control unit is arranged to selectively operate the translator on the basis of said obtained lighting device control command to translate the lighting device control command into light generation control commands for each of said at least two light units.

For example, the primary control unit is arranged to selectively operate the translator on the basis of said obtained lighting device control command and to select an addressing communication mode for communicating said light generation control commands to said at least two light units. For example, said lighting device control command requiring light generation control of at least two light units of the lighting device may be a lighting device control command requiring control of light generation of all light units of the lighting device, or a lighting device control command related to light generation control of only some of the light units of the lighting device. For example, the light units are not required to perform complex operations of coordinated control of light units, because coordination may be performed by the primary control unit. Thus, the processing capabilities of the light units may be reduced. For example, lighting device control commands requiring a complex processing or a coordinated control of more than one light unit may be translated into a simpler light generation control commands which, for example, may be executed by the light units without interaction between the light units. Thus, for example, dynamic light effects may be performed by the lighting device having light units of a simplified structure and reduced complexity. Moreover, communication within the lighting device is efficient, because a broadcast communication mode may be used for other, e.g. simpler lighting device control commands received by the primary control unit.

For example, the primary control unit is arranged to selectively perform, on the basis of said obtained lighting device control command, one of:

operating the translator and communicating said light generation control commands to the respective said at least two light units via the control unit interface using at least one addressing communication mode; and communicating at least one light generation control command to said group of light units via the control unit interface using a broadcast communication mode. For example, in the latter case, the primary control unit may generate at least one light generation control command on the basis of said obtained lighting device control command. For example, the lighting device control command may be relayed to the light units in form of a light generation control command by the primary control unit.

For example, the primary control unit is arranged to communicate said at least one light generation control command to said at least one of said light unit interfaces, wherein said at least one light generation control command is executable by each respective light unit, to the light unit interface of which it is to be communicated, independently of any other light unit of the group of light units. In particular, it may be executable without requiring communication between the light units. In other words, any light generation control command that is communicated by the primary control unit to any light unit of the group of light units in a broadcast communication mode or an addressing communication mode is a light generation control command that is executable, by the respective at least one light unit it is directed to, independently of any other of said group of light units, and, more particularly, executable without requiring communication between light units. When no communication is required between the light units, the structure of the light units and the light unit interfaces may be considerably simplified.

For example, said light unit interface of each of said group of light units is arranged to be operated, with the exception of an initialization of the respective light unit, in a slave communication mode only. Thus, the structure of the light unit interface may be considerably simplified, and the communication within the lighting device may be simplified.

For example, the control unit interface is arranged to communicate said at least one light generation control command to at least one of said light unit interfaces of at least one respective one of said of group of light units via the control unit interface being operated in a master communication mode, and said at least one of said light unit interfaces is arranged to be operated in a slave communication mode during receiving said at least one light generation control command and during execution of said at least one light generation control command by the respective light unit. Thus, the light unit interface may be operated in a slave communication mode only, optionally with the exception of an initialization phase of the lighting device. Said initialization comprises the above described address identification initialization.

For example, the lighting device may optionally further comprise at least one secondary control unit, which comprises a secondary control unit interface for communicating with the primary control unit via the primary control unit interface. The at least one secondary control unit may be part of said power supply chain of lighting device units.

In a further aspect of the invention, there is provided a light system, comprising a plurality of lighting devices as described above, and a system controller, which is arranged for generating lighting device control commands, and communicating said lighting device control commands to primary control units of said lighting devices via a system interface of the system controller and via lighting device interfaces of said lighting devices. For example, the system interface is a bus interface, and the lighting device interfaces are bus interfaces connected to the system interface via a system bus.

In a further aspect of the invention, there is provided a lighting device unit for being arranged in the power supply chain of the lighting device as described above, the unit comprising:

an interface for sending or receiving lighting device unit control commands;

a power input;

a switchable power output;

wherein the lighting device unit is arranged to initialize an address identification of the unit upon being supplied with power at the power input, and wherein the lighting device unit is arranged to supply power at the power output only after initializing an address identification of the unit.

For example, the lighting device unit may be one of the primary control unit, the secondary control unit, and the light unit as described above.

In a further aspect of the invention, there is provided a method of initializing addresses of lighting device units of a lighting device, which lighting device units are arranged in a power supply chain of lighting device units, the method comprising steps of:

(a) a preceding lighting device unit initializing a lighting device unit address identification; and (b) the preceding lighting device unit supplying power to a succeeding lighting device unit;

(c) the succeeding lighting device unit initializing a lighting device unit address identification;

steps (b) and (c) being repeated for each succeeding lighting device unit of said chain of lighting device units. For example, the succeeding lighting device unit initializes a lighting device unit address identification after being powered.

For example, the method comprises:

a first unit in the chain of units assigning different address identifications to succeeding units and communicating said address identifications to the respective succeeding units, and the step (c) of the succeeding lighting device unit initializing a lighting device unit address identification comprises the succeeding lighting device unit receiving an address identification from said first unit.

For example, said lighting device units include the primary control unit, and the method further comprises:

the first lighting device unit notifying, in case the first lighting device unit is not the primary control unit, the primary control unit of completion of the address initialization of all succeeding units of the chain of units.

In a further aspect of the invention, there is provided a method of controlling light units of a lighting device, which light units are arranged in a power supply chain of lighting device units, the method comprising said method of initializing addresses of lighting device units of a lighting device, the method further comprising:

obtaining a lighting device control command;

selecting, on the basis of the obtained lighting device control command, a broadcast communication mode or an addressing communication mode for communication to at least one light unit of the lighting device; and communicating at least one light generation control command to at least one light unit of the lighting device using the selected communication mode.

For example, said method of controlling light units of a lighting device may further comprise:

selectively translating, in case of an obtained lighting device control command requiring light generation control of at least two light units, and depending on the obtained lighting device control command, the obtained lighting device control command into light generation control commands for each of said at least two light units and communicating said light generation control commands to each of said at least two light units using an addressed communication mode.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
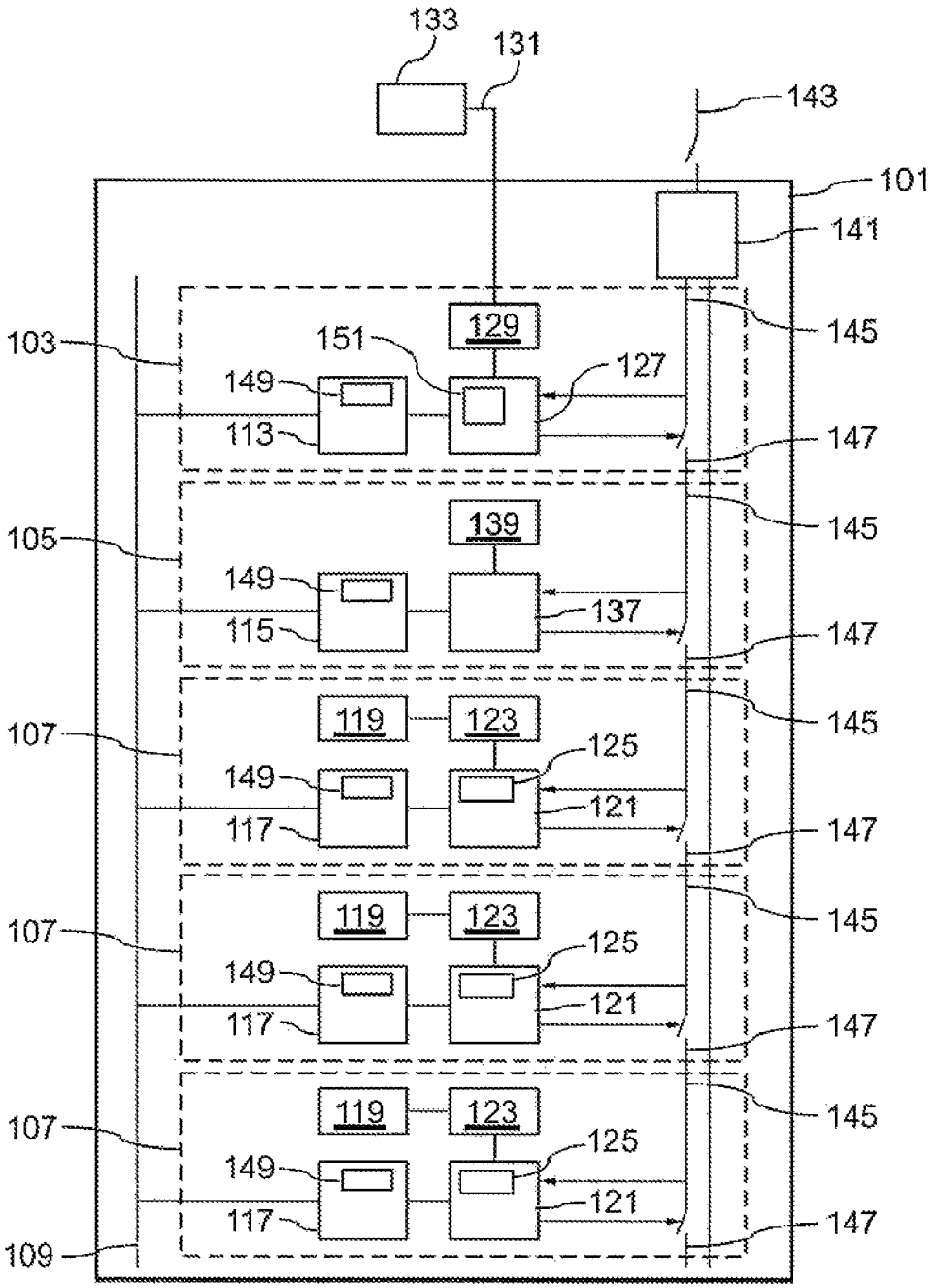
FIG. 1 is a block diagram of an embodiment of a lighting device according to the present invention.

Referring to FIG. 1, an embodiment of a lighting device 101, such as a luminaire, a light source, or a fixture, comprises a primary control unit 103. Further, the lighting device may optionally comprise a secondary control unit 105. Further, the lighting device comprises a group of light units 107. The secondary control unit 105 and the light units 107 are connected via a lighting device bus 109 to the primary control unit 103.

In particular, the primary control unit 103 comprises a control unit interface 113 connected to the lighting device bus 109, the secondary control unit 105 comprises a control unit interface 115 connected to the lighting device bus 109, and the light units 107 each comprise a light unit interface 117 connected to the lighting device bus 109.

Each light unit 107 comprises multiple light elements 119 and a light element controller 121, which is connected to drivers 123 of the light elements 119. In FIG. 1, only one exemplary light element 119 and one exemplary driver 123 is shown per light unit 107. For example, each light unit 107 may comprise light elements 119 of at least three different colors, such as red, green and blue, so that a light unit 107 can generate a large palette of colors. The light element controller 121 is connected to the light unit interface 117. The light element controllers 121 are used for causing the lighting device 101 to emit light of a desired character, for example as regards color and intensity. For example, the light elements 119 are LEDs, but any solid state light (SSL) element is incorporated within the scope of this invention. Additionally, the invention is applicable to conventional lighting devices (TL, HID, etc) and hybrids having controllable light elements. Each light element controller 121 is arranged to obtain light element data. For example, each light element controller 121 has a storage 125, in which light element data, such as peak wave lengths, flux and temperature behavior, for the light element 119 is stored. The light element controller 121 is arranged to generate light element drive signals for the light element driver 123 on the basis of a light generation control command received via the light unit interface 117 and, optionally, on the basis of said light element data.

The primary control unit 103 has a controller 127 that is connected to the control unit interface 113. Further, the controller 127 is connected to a lighting device interface 129, which, in the embodiment of FIG. 1, is a bus interface to be connected to a system bus 131. Via the system bus 131, the lighting device 101 may be connected to a system interface 133 of a light system.

The secondary control unit 105 comprises a controller 137 connected to the control unit interface 115. The controller 137 is further connected to at least one control device 139 of the secondary control unit 105. For example, the control device 139 comprises a sensor. For example, the controllers 127 and 137 are arranged to communicate with each other via the lighting device bus 109.

The lighting device 101 is advantageously modular, the light units 107 being light modules and, preferably, the control units 103 and/or 105 also being control modules. These modules are detachable. Thus, for example, a defective light unit 107 may easily be exchanged.

Power supply of the modules or units is via a power supply 141 in the form of a power supply module, which may be connected to mains 143. The control units 103, 105 and light units 107 are arranged in the form of a power supply chain, wherein a power input 145 of the first unit is connected to a power output of the power supply 141, and a power input 145 of a succeeding unit is connected to a switchable power output 147 of the preceding unit. In the embodiment shown, the primary control unit 103 is the first unit, the power input 145 of which being connected to the power supply 141.

On power-up, an initialization is performed as follows. On power-up of each lighting device unit, the respective unit has a default address identification. For example, each light unit 107 and each control unit 103, 105 may have the same default address, and new, individual address identifications are assigned as follows.

The primary control unit 103, being the first lighting device unit in the chain, is supplied with power and initializes a primary control unit address identification, said address identification being stored in a storage 149 of the control unit interface 113. For example, the address identification is a predetermined primary control unit address identification, which may be a fixed address known to all units of the chain.

Then, the unit 103 switches power on its power output 147, and initialization of the succeeding unit, which is the secondary control unit 105 in the described example, is executed as the secondary control unit 105 is powered. For example, the controller 127 of the primary control unit 103 may assign an available, unique address identification to the secondary control unit 105 via the lighting device bus 109 using the default address of the unit 105. The new address identification is stored in the storage 149 of the control unit interface 115. Thus, the unit 105 has received a new address identification.

After initializing the secondary control unit address identification, the controller 137 switches power on at its power output 147. The procedure is repeated in an analogous manner for each light unit 107. Thus, one after the other, the light units 107 are powered, and a unique light unit address identification of each light unit 107 is initialized and stored in the respective storage 149 of the light unit interface 117. After initializing the respective light unit address identification, its controller 121 switches power on at its power output 147.

In this way, address identifications may be assigned to the control units 103, 105, and light units 107, which address identifications are unique within the lighting device 101. For example, the first unit 103 may assign subsequent addresses to the succeeding units 105, 107.

For example, the first unit 103 recognizes when all units connected to the lighting device bus 109 have been initialized, e.g. from receiving no response from the default address. That is, the first unit 103 detects a situation where no further unit 105, 107 responds to the default address. Optionally, the first unit 103 may repeatedly try to send a command to the default address before detecting that no further unit responds.

In another example, a control unit 105 or a light unit 107 may be the first unit in the power supply chain. A unit may know that it is the first unit, for example, from detecting that it is not addressed from another unit, i.e. it does not receive communication messages for address initialization. For example, a unit is arranged to detect whether it is the first unit based on whether the unit receives a command to change its address within a predetermined time after being powered.

Figure 2:
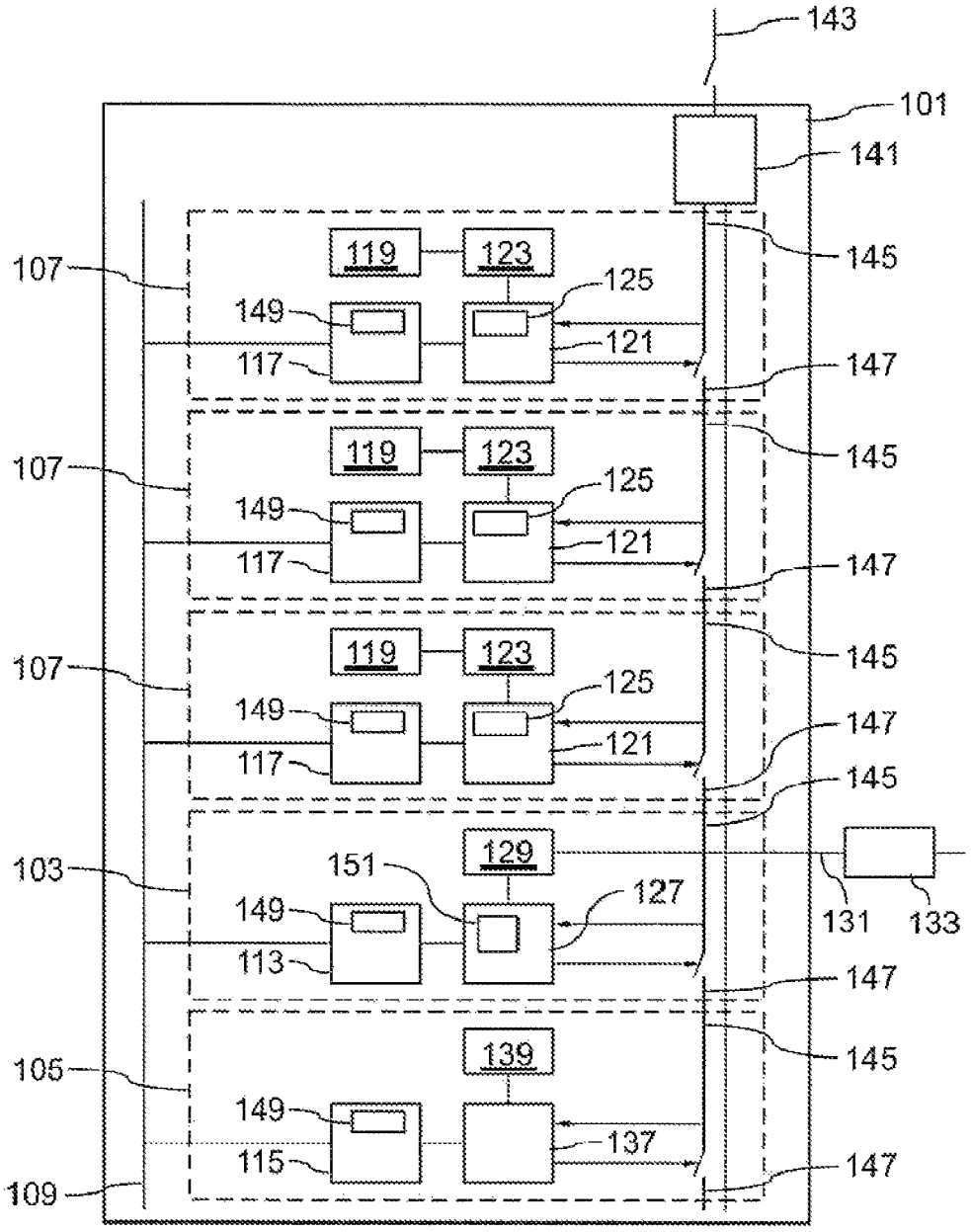
FIG. 2 is a block diagram of a further embodiment of a lighting device.

For example, FIG. 2 shows a lighting device 101 similar to that of FIG. 1, wherein a light unit 107 is the first unit in the power supply chain. In this case, the address initialization may be performed in an analogous manner, with the light unit 107 assigning unique address identifications to itself and to the control units 103, 105 and the other light units 107 via the lighting device bus 109, using the default address identification for addressing each succeeding unit. However, when the primary control unit 103 is requested to change its address, it will always assign the fixed predetermined primary control unit address identification instead. When the first unit 107 recognizes that all units connected to the lighting device bus 109 have been initialized, it reports to the primary control unit 103, using the known predetermined primary control unit address identification, that the address initialization is completed.

In the described examples of FIGS. 1 and 2, by switching on the power at the power output 147, the respective unit 103, 105 or 107 outputs an initialization signal to the succeeding unit 103, 105 or 107, which is received at the power input 145 of the succeeding unit 103, 105, 107. In other words, switching power on represents an initialization signal for a succeeding unit 103, 105, 107.

For example, the controller 127, the controller 137, and the light element controller 121 also form an address initializer for initializing the address identification of the respective unit 103, 105 or 107. The address initializer is connected to the respective control unit interface 113, 115 or light unit interface 117 and is arranged to perform the address initialization and/or address initialization steps as described above. The light element controller 121 and the controllers 127, 137 are also arranged to switch the respective power output 147 of the respective unit 103, 105 or 107.

Furthermore, during the initialization, a power-up configuration of each unit 103, 105 and 107 will take place. Furthermore, additionally to initializing an address identification, each unit may also initialize a group identification.

After the address identification stage, the lighting device control operates as follows. For example, via the lighting device interface 129, the primary control unit 103 receives a lighting device control command. For example, the lighting device control command may comprise experience data. Experience data relates to an experience that a user of the lighting device is supposed to experience as a result of the output from the lighting device, such as soft evening light, night darkness, bright working light, etc. Furthermore, the lighting device control command may relate to a dynamic light effect to be performed by the lighting device 101, e.g. a sunrise effect.

The control unit 127 of the primary control unit 103 comprises a translator 151 for receiving such a lighting device control command requiring light generation control of at least two light units 107, and for translating the lighting device control command into light generation control commands for each of said light units 107. The primary control unit 103 is arranged to selectively operate the translator 151, depending on the obtained lighting device control command, to translate the lighting device control command into light generation control commands for at least two of the light units 107 and to select an addressing communication mode for communicating said light generation control commands to the light units 107 via the lighting device bus 109. Thus, complex light effects, such as light effects requiring coordination of two or more light units 107, are translated into a simple light generation control commands for each light unit 107 that participates in performing the effect. Thereby, each light unit 107 receives light generation control commands that may be executed by the individual light unit 107 independently of the other light units 107, since temporal and/or positional coordination can be controlled by the controller 127. Thus, only the primary control unit 103 has the application knowledge required for executing the complex lighting device control commands.

Depending on the obtained lighting device control command, the primary control unit may also operate the translator to translate a lighting device control command into at least one light generation control command for all light units 107 of the group of light units 107 and to select a broadcast communication mode for communicating said at least one light generation control command to the light units 107. This will be done for simple commands that are executable by each of the light units 107 independently of any other of the light units 107.

Furthermore, depending on the received lighting device control command, the primary control unit may relay a received lighting device command as a light generation control command. For example, a lighting device control command, such as a command for switching off all light, may be communicated to the light units 107 using a broadcast communication mode of the lighting device bus 109.

Furthermore, an individual light unit 107 may be addressable via a lighting device control command, which is relayed by the primary control unit as a light generation control command addressed to one light unit 107 using an addressing communication mode for communicating the light generation control command to the respective light unit 107 via the lighting device bus 109.

In general, by selectively operating the translator 151 depending on the received lighting device control command, complex lighting device control commands may be translated into simpler light generation control commands, each being executable by the respective light unit(s), to which it is directed, independently of any other of the light units 107.

For example, the light unit interfaces 117 of the light units 107 are arranged to be operated in a slave communication mode only, during execution of a light generation control command. Therefore, the structure of the light unit 107 is simplified. This is particularly advantageous in case the light units 107 are detachable light modules. For example, only the control unit interfaces 113, 115 of the primary and secondary control units 103, 105 are arranged to be operated in a master communication mode and/or a slave communication mode, whereas the light unit interfaces 117 of the light units 107 are arranged to be operated only in a slave communication mode, during execution of a light generation control command.

Thus, the primary control unit 103 is arranged to select, on the basis of a received lighting device control command, a broadcast communication mode or an addressing communication mode of the control unit interface 113, and to communicate at least one light generation control command to at least one of the light unit interfaces 117 of the respective light units 107 via the control unit interface 113 using the selected communication mode. Further, the primary control unit 103 is arranged to selectively operate the translator 151 on the basis of the received lighting device control command to translate the lighting device control command into at least one light generation control command for at least two light units 107 of the lighting device 101 and to select, on the basis of the received lighting device control command, a broadcast communication mode or an addressing communication mode of the control unit interface 113, and to communicate the at least one light generation control command to the respective light unit interfaces 117 of said at least two light units 107 via the control unit interface 113 using the selected communication mode.

Via the lighting device interface 129, the primary control unit 103 may be connected outside the lighting device 101. For example, the primary control unit 103 may be connected to a network of lighting devices 101.

Figure 3:
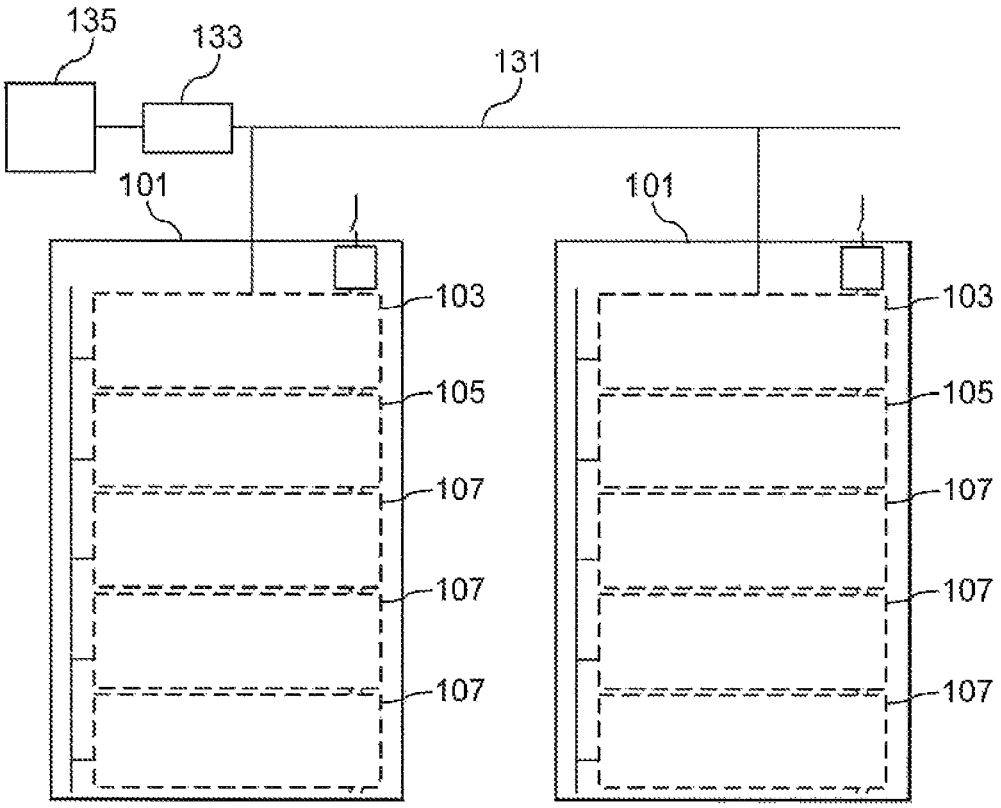
FIG. 3 is a block diagram of an embodiment of a light system according to the present invention.

FIG. 3 shows an example of a light system or luminaire system comprising a plurality of lighting devices 101 and an external system controller 135, which is connected to the lighting devices 101 via a system interface 133 and a system bus 131 as described above. The system controller 135 is arranged for generating lighting device control commands and communicating said lighting device control commands to the primary control units 103 of the lighting devices 101 via the system bus 131.

While the invention has been illustrated and described in detail in the drawings and foregoing description, such illustration and description are to be considered illustrative or exemplary and not restrictive; the invention is not limited to the disclosed embodiments.

The units 103, 105, 107 may be arranged in any order in the power supply chain. For example, in the system of FIG. 3, any lighting device 101 may be configured as in FIG. 1 or in FIG. 2, or in a similar configuration.

For example, the lighting device interface 129 of the primary control unit 103 may comprise a wireless communications interface additionally to or instead of a bus interface. Furthermore, for example, the lighting device interface 129 may comprise a user interface. For example, the primary control unit 103 may receive a lighting control command via the user interface, e.g. generated from a user input. Furthermore, for example, the lighting device interface 129 may comprise a sensor, and, for example, the lighting device interface 129 may be adapted to generate a lighting control command based on a sensor output. Furthermore, for example, the lighting device interface 129 may be implemented in a secondary control unit 105, e.g. in the form of a control device 139, and the primary control unit 103 may be connected to the lighting device interface 129 via the control unit interfaces 113, 115 and the lighting device bus 109.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device, comprising:

a plurality of lighting device units arranged in a power supply chain, the plurality of lighting device units comprising:

a primary control unit comprising a control unit interface; and a group of light units, each light unit of said group being arranged for receiving commands from the primary control unit via a light unit interface of the light unit, wherein said group of light units and said primary control unit are arranged in the power supply chain to successively receive power originating from a power supply, such that each succeeding lighting device unit comprises a power input which is connected to a switchable power output of a respective preceding lighting device unit, wherein each preceding lighting device unit is configured to supply power at the switchable power output in response to initializing an address identification of the lighting device unit, wherein each succeeding lighting device unit is configured to initialize an address identification of the lighting device unit in response to being supplied with power at the power input.

2. The lighting device according to claim 1, wherein each lighting device unit of the power supply chain is configured to assign, when said lighting device unit is the first lighting device unit in the power supply chain, a different address identification to at least one succeeding lighting device unit and communicate said address identification to the at least one respective succeeding lighting device unit, and wherein each lighting device unit of the power supply chain is configured to receive, when said lighting device unit is a succeeding lighting device unit, in the power supply chain, an address identification from the first lighting device unit in the power supply chain.

3. The lighting device according to claim 1, wherein said initializing an address identification of a lighting device unit comprises:

assigning, when the lighting device unit is the first lighting device unit in the power supply chain, an address identification; and receiving, when the lighting device unit is a succeeding lighting device unit in the power supply chain, an address identification from the first lighting device unit in the power supply chain.

4. The lighting device according to claim 1, wherein said initializing an address identification of a lighting device unit comprises assigning, when the lighting device unit is the primary control unit, a predetermined primary control unit address identification.

5. The lighting device according to claim 1, wherein the control unit interface is a bus interface, and the light unit interfaces are bus interfaces connected to the bus interface of the primary control unit via a lighting device bus.

6. The lighting device according to claim 1, wherein each lighting device unit of the power supply chain is arranged to operate, when said lighting device unit is a succeeding unit in the power supply chain, its respective control unit interface or light unit interface in a slave communication mode only, at least until completion of said initializing an address identification of the lighting device unit.

7. The lighting device according to claim 1, wherein said initializing an address identification of the lighting device unit comprises changing a default address identification to an individual address identification.

8. The lighting device according to claim 1, wherein said lighting device units of the power supply chain each comprise an address initializer for initializing an address identification of the lighting device unit, which initializer is connected to said interface of the respective unit and arranged to obtain an address identification of the lighting device unit.

9. The lighting device according to claim 1, wherein each light unit of said group of light units is arranged to notify, in case said light unit is the first lighting device unit in the power supply chain, the primary control unit of completion of the address initialization of all succeeding lighting device units of the power supply chain.

10. The lighting device according to claim 1, said lighting device being one of a luminaire and a light source.

11. A light system, comprising a plurality of lighting devices according to claim 1, and a system interface which is arranged for communicating lighting device control commands to at least one primary control unit of said lighting devices via lighting device interfaces of said lighting devices.

12. A lighting device unit for being arranged in a power supply chain of a lighting device, the light device unit comprising:

an interface for sending or receiving lighting device unit control commands;

a power input connectable to a preceding lighting device unit;

a switchable power output connectable to a succeeding lighting device unit;

wherein the lighting device unit is arranged to initialize an address identification of the unit upon being supplied with power at the power input, and wherein the lighting device unit is arranged to supply power at the power output only after initializing an address identification of the unit.

13. The lighting device unit according to claim 12, wherein the lighting device unit is a light unit that comprises at least one light element and at least one light element controller connected to the at least one light element and arranged to generate light element drive signals on the basis of a light generation control command received via the interface of the light unit.

14. A method of initializing addresses of lighting device units of a lighting device, which lighting device units are arranged in a power supply chain of lighting device units, the method comprising:

initializing a lighting device unit address identification by a preceding lighting device unit; and supplying power to a succeeding lighting device unit by the preceding lighting device units via switchable power outputs of the preceding lighting device units;

initializing a lighting device unit address identification by the succeeding lighting device unit; and repeating the supplying of power and the initializing of the lighting device unit address identification for each succeeding lighting device unit of said power supply chain of lighting device units.

15. The method according to claim 14, comprising:

assigning a different address identification to at least one succeeding lighting device unit and communicating said address identification to the respective at least one succeeding lighting device unit by a first lighting device unit in the power supply chain, wherein initializing comprises receiving an address identification from said first lighting device unit by the succeeding lighting device unit.

* * * * *